US005359759A

United States Patent [19]

Jacob et al.

[11] Patent Number: 5,359,759

[45] Date of Patent: Nov. 1, 1994

[54] TWO-COMPONENT LOOP SEWING YARN AND MANUFACTURE THEREOF

[75] Inventors: Ingolf Jacob, Untermeitingen; Josef Geirhos, Bobingen, both of Germany

[73] Assignee: Hoechst Aktiengesellschaft, Frankfurt am Main, Germany

[21] Appl. No.: 161,980

[22] Filed: Dec. 3, 1993

Related U.S. Application Data

[60] Continuation of Ser. No. 773,705, Oct. 9, 1991, abandoned, which is a division of Ser. No. 417,904, Oct. 6, 1989, Pat. No. 5,100,729.

[30] Foreign Application Priority Data

Oct. 7, 1988 [DE] Germany ..... 3834139

[51] Int. Cl.[5] ..... D02G 1/16; D02J 1/22

[52] U.S. Cl. ..... 28/271; 28/240; 28/246

[58] Field of Search ..... 28/271, 240, 246

[56] References Cited

U.S. PATENT DOCUMENTS

| | | | |
|---|---|---|---|
| 3,423,809 | 1/1969 | Schmitt | 28/246 X |
| 4,319,447 | 3/1982 | Barron | 28/271 X |
| 4,437,301 | 3/1984 | Eschenbach et al. | 28/271 X |
| 4,467,594 | 8/1984 | Eschenbach et al. | 28/271 X |
| 4,567,720 | 2/1986 | Price | 28/240 X |
| 4,896,407 | 1/1990 | Haynes | 28/271 X |
| 5,083,419 | 1/1992 | Greifeneder et al. | 57/6 |
| 5,100,729 | 3/1992 | Jacob et al. | 57/6 |
| 5,146,738 | 9/1992 | Greifeneder et al. | 57/207 |

FOREIGN PATENT DOCUMENTS

| | | | |
|---|---|---|---|
| 0057583 | 9/1984 | European Pat. Off. . | |
| 0123479 | 10/1984 | European Pat. Off. . | |
| 295601 | 6/1988 | European Pat. Off. . | |
| 28212 | 6/1987 | Japan | 28/271 |
| 6503706 | 3/1966 | Netherlands | 28/271 |

*Primary Examiner*—Clifford D. Crowder
*Assistant Examiner*—Bibhu Mohanty
*Attorney, Agent, or Firm*—Connolly & Hutz

[57] ABSTRACT

Two-component loop sewing yarn composed of core and effect filaments of high tenacity and low shrinkage made of synthetic polymers, having an ultimate tenacity of above 40 cN/tex, a thermoshrinkage at 180° C. of below 8% and an ultimate tensile strength elongation of below 18%, has a total count of 200 to 900 dtex, its core filaments and effect filaments being in a weight ratio of 95:5 to 70:30 with the linear density of the core filaments being 8 to 1.2 dtex and that of the effect filaments being 4.5 to 1 dtex.

12 Claims, 1 Drawing Sheet

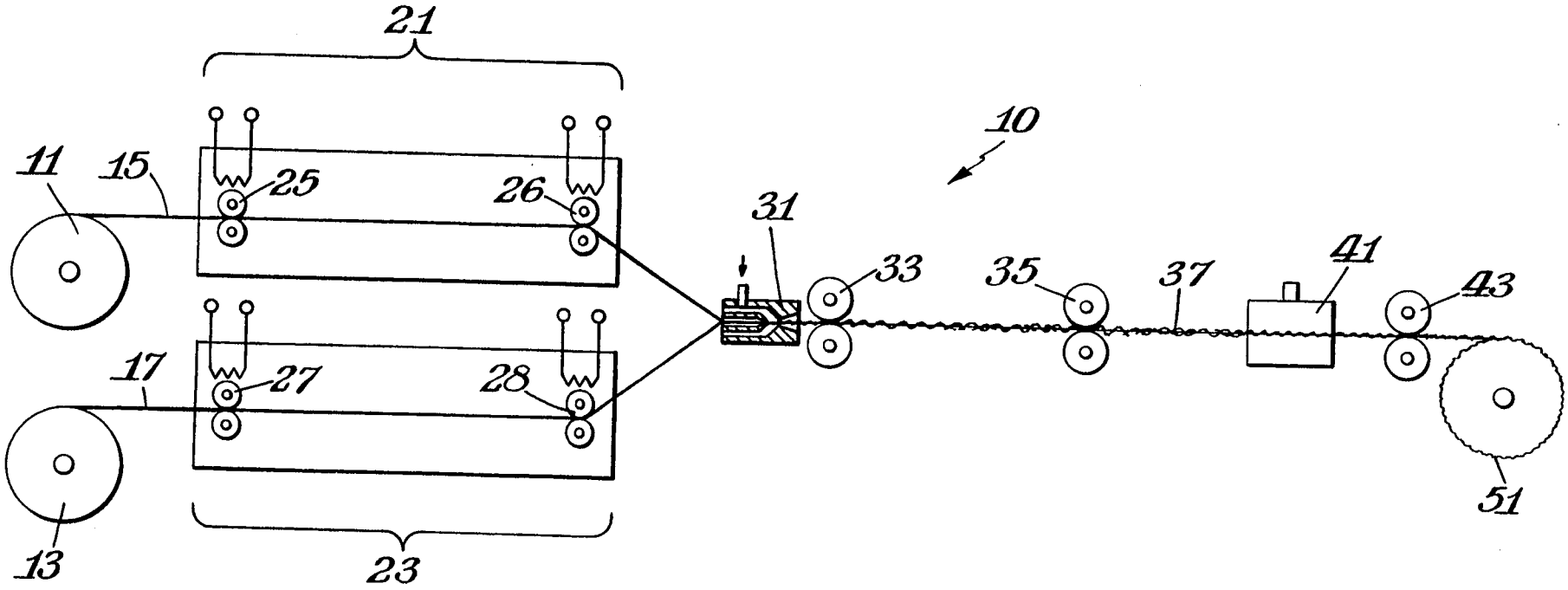
10
11
13
15
17
21
23
25
26
27
28
31
33
35
37
41
43
51

TWO-COMPONENT LOOP SEWING YARN AND MANUFACTURE THEREOF

This application is a continuation of application Ser. No. 07/773,705 filed Oct. 9, 1991, now abandoned, which was a divisional of application Ser. No. 07/417,904 filed Oct. 6, 1989, now U.S. Pat. No. 5,100,729.

The present invention relates to a two-component loop sewing yarn for modern industrial sewing machines of high tenacity combined with low shrinkage, and to a process for manufacturing same.

A similar loop sewing yarn is known for example from EP-A-57,583. By the process described therein, a plurality of yarns having different shrinkages are plied by air Jet texturing at different rates of overfeed to produce a loop yarn. The loop yarn is then allowed to shrink in a subsequent setting process which tightens up the loops of filament into bud-like projections. In an improved form of this known process described in EP-A-123,479, the yarns are additionally twisted between loop formation and setting at about 100 to 300 turns per meter.

A disadvantage of these known processes lies in the fact that the ultimate tenacity of the ready-produced loop yarn is lower than would be expected from the tenacity of the feed yarns. The ultimate tenacity of these known sewing yarns is only between 25 and 40 cN/tex, the ultimate tenacity here being defined as the ratio of the ultimate tensile strength and the ultimate linear density at break. Moreover, the filaments of these known yarns may shrink to widely differing extents, depending on the degree of binding. These differences then show up in variable dyeability along a filament and are particularly marked from filament to filament if yarns having different shrinkage properties have been used.

There are also single-component loop sewing yarns whose ultimate tenacity is between 40 and 50 cN/tex. However, these yarns have inadequate sewing properties owing to their small number of loops. They have been twisted like conventional sewing yarns to about 600 to 800 turns per meter, and the elongation at break is relatively high at over 18%.

The present invention provides a two-component loop sewing yarn which does not exhibit the above-described prior art disadvantages.

The high-tenacity, low-shrinkage two-component loop sewing yarn according to the invention is formed from core and effect filaments made of synthetic polymers such as, for example, polyamides, polyacrylonitrile and polypropylene but preferably polyesters and in particular polyethylene terephthalate, and has an ultimate tenacity, i.e. an ultimate tensile strength per ultimate linear density at break, of above 40 cN/tex, preferably 48 to 60 cN/tex, a thermoshrinkage at 180° C. of below 8%, preferably below 5%, and an ultimate tensile strength elongation of below 18%, preferably below 15%.

The ultimate tenacity is the ratio of the ultimate tensile strength to the ultimate linear density at break; the ultimate tensile strength elongation is elongation under the action of the ultimate tensile strength.

The total count of the two-component loop sewing yarn according to the invention is in general 200 to 900 dtex. Higher and lower counts may likewise be manufactured, if they are of interest in a particular case, but are not the general rule. As mentioned above, the two-component loop sewing yarn according to the invention is composed of core filaments and effect filaments. Core filaments are on average much more oriented in the direction of the fiber axis than effect filaments, which are intermingled with and wrapped round the core filaments but in addition, owing to their greater length, form loops which stick out from the fiber assembly and hence are a significant factor in determining the textile properties and performance characteristics of the yarn according to the invention. The total linear densities of the core and effect filaments making up the loop sewing yarn according to the invention are in a ratio of 95:5 to 70:30, preferably 90:10 to 80:20.

Core filaments and effect filaments differ in linear density. The core filament linear density is 8 to 1.2, preferably 5 to 1.5, dtex, and the effect filament is 4.5 to 1, preferably 3 to 1.4, dtex. Within these linear density limits, the filament linear density of the core filaments is 1.2 to 6 times, in particular 1.5 to 3 times, the linear density of the effect filaments.

In principle, the two-component loop sewing yarns according to the invention can be produced from the abovementioned synthetic spinnable polymers and poly-condensation products such as polyamide, polyacrylo-nitrile, polypropylene and polyester, but it is particularly advantageous to use polyester. Suitable polyesters are in particular those which are obtained essentially from aromatic dicarboxylic acids, for example phthalic acid or isophthalic acid, 1,4-, 1,5- and 2,6-naphthalenedicarboxylic acid, hydroxycarboxylic acids, for example para-(2-hydroxyethyl)benzoic acid, and aliphatic diols of 2 to 6, preferably 2 to 4, carbon atoms, for example ethylene glycol, 1,3-propanediol or 1,4-butanediol, by condensation. These polyester raw materials can also be modified by incorporation as cocondensed units of minor amounts of aliphatic dicarboxylic acids, for example glutaric acid, adipic acid or sebacic acid, or of polyglycols such as diethylene glycol (2,2-dihydroxydiethyl ether) or triethylene glycol (1,2-di(2-hydroxyethoxy)ethane), or else of minor amounts of higher molecular polyethylene glycols. A further possible modification, which affects in particular the dyeing properties of the two-component loop sewing yarns according to the invention, is modification by means of sulfo-containing units, for example by the incorporation of sulfoisophthalic acid.

The upper limit of the ultimate tenacity of the loop sewing yarns according to the invention depends on the degree of condensation of the polymer material, in particular the polyester material, used. The degree of condensation of the polyester is evident in its viscosity. A high degree of condensation, i.e. a high viscosity, leads to particularly high ultimate tenacities of the yarns according to the invention. Preference is therefore given to the manufacture of loop sewing yarns according to the invention from high molecular weight polyesters having an intrinsic viscosity (IV) of above 0.65 dl/g, in particular above 0.75 dl/g, measured in solutions in dichloroacetic acid (DCA) at 25° C.

A preferred polyester material for manufacturing the loop yarns according to the invention is polyethylene terephthalate.

BRIEF DESCRIPTION OF THE DRAWING

The accompanying Drawing is a schematic representation illustrating a preferred apparatus for carrying out the method for manufacturing a loop sewing yarn having a plurality of components in accordance with this invention.

DETAILED DESCRIPTION

The two-component (core/effect) filament loop sewing yarn according to the invention is manufactured by air Jet texturing two feed yarn strands which have different total and filament linear densities and are supplied at different rates of overfeed but which both consist of high-tenacity, low-shrinkage and low-stretch filaments.

For the purposes of the present invention, high-tenacity, low-shrinkage and low-stretch filaments have an ultimate tensile strength per ultimate linear density of not less than 65 cN/tex, in general 65 to 90 cN/tex, preferably 70 to 80 cN/tex, an ultimate tensile strength elongation of not less than 8%, in general 8 to 15%, preferably 8.5 to 12%, and a thermoshrinkage at 180° C. of not more than 9%, in general 5 to 9%, preferably 6 to 8%.

In the air Jet texturing of yarns, as will be known, the filament material is fed into the Jet of compressed air at a higher rate than the rate with which it is drawn off by the take-off rolls. The percentage by which the rate of feed is higher than the rate of take-off, based on the take-off speed, is referred to as the overfeed. In the process according to the invention, then, the two yarn strands to be mixed, which in the ready-produced yarn will then constitute the core or effect filaments, are supplied to the texturing Jet at different rates of overfeed. The feed yarn strand which will ultimately form the core filaments of the yarn according to the invention is overfed into the air Jet at an overfeed of 3 to 10%, while the feed yarn strand which will ultimately form the effect filaments of the yarn according to the invention is overfed at an overfeed of 10 to 60%. Owing to these different rates of overfeed, longer lengths of the effect filaments are tangled in the texturing jet with shorter lengths of the core filaments, the result being that the effect filaments in the ready-produced yarn according to the invention form substantially more pronounced curls and loops than the core filaments, which extend essentially in the direction of the fiber axis.

The total linear densities of the feed yarn strands forming the core filaments and the effect filaments are selected in such a way that they form a ratio of 95:5 to 70:30, preferably 90:10 to 80:20, and that, after entanglement, their blend has a linear density of 200 to 900 dtex.

It has to be noted here that the total linear density $LD_{tot}$ of the intermingled yarn is not simply the sum of the linear densities of the feed yarns but that it is necessary here to take into account the overfeed of the two feed yarns. The total linear density $LD_{tot}$ is accordingly given by the following formula:

$$LD_{tot} = LD_c \times \left(1 + \frac{OF_c}{100}\right) + LD_E \times \left(1 + \frac{OF_E}{100}\right)$$

where $LD_c$ and $OF_c$ are the linear density and overfeed of the core feed yarn and $LD_E$ and $OF_E$ are the linear density and overfeed of the effect feed yarn.

The linear density of the filaments of the core feed yarn is 8 to 1.2, preferably 5 to 1.5, dtex, and the linear density of the filaments of the effect feed yarn is 4.5 to 1, preferably 3 to 1.4, dtex. Within the range of these values, the filament linear densities of the feed yarns are chosen in such a way that the linear density of the core filaments is from 1.2 to 6 times, preferably from 1.5 to 3.5 times, the linear density of the effect filaments.

The feed yarns for manufacturing the two-component loop sewing yarn according to the invention can be the high-tenacity and low-shrinkage yarns described for example in DE-B-1,288,734 and EP-A-173,200. Preferably, however, the feed yarns required for the process according to the invention are manufactured in an integrated step which immediately precedes the air texturing step and in which the feed yarns are obtained by drawing partially oriented yarn material and an immediately subsequent, essentially shrinkage-free heat treatment. Essentially shrinkage-free is supposed to convey that, during the heat treatment, the yarns are preferably kept at a constant length but that a shrinkage of up to 4%, preferably not above 2%, can be allowed. In this preferred embodiment of the process according to the invention, therefore, two partially oriented yarns having different total and filament linear densities are drawn on separate drawing systems, subjected to an essentially shrinkage-free heat treatment and immediately thereafter fed into a texturing jet of compressed air. The partially oriented yarns are drawn at a temperature of 70° to 100° C., preferably over heated godet rolls, under a drawing tension within the range from 10 to 25 cN/tex, preferably from 12 to 17 cN/tex (each figure being based on the drawn linear density). After drawing, the immediately following, essentially shrinkage-free heat treatment of the yarns is carried out at a yarn tension between 2 and 20 cN/tex, preferably at 4 to 17 cN/tex, and at a temperature within the range from 180° to 250° C., preferably from 225° to 235° C. This heat treatment may in principle be carried out in any known manner, but it is advantageous to effect the heat treatment directly on a heated take-off godet.

Preferably, in the practice of the process according to the invention, the drawing conditions for the two partially oriented yarns are ideally kept the same. However, differences in the drawing conditions of up to ±10% can be tolerated.

If desired, the loop yarn emerging from the air-texturing jet may additionally be subjected to a setting process. This setting process can likewise be carried out in a conventional manner, but it is advantageous to subject the yarn at a constant length to a hot air treatment at temperatures of 200° to 320° C., preferably 240° to 300° C.

The two-component loop sewing yarn thus obtained surprisingly has a number of advantages over existing sewing yarns:

The loops in the individual filaments remain fully intact and, owing to the entrained air, give good sewing properties even at high sewing speeds. This advantage is particularly evident from the high values for the sewing length to break, determined by the method known from DE-A-3,431,832. The uniformly drawn filaments show uniform dyeability and hence a level appearance of the seam. The tenacity of the yarns thus manufactured is significantly higher than that of sewing yarns composed of filaments having different shrinkage properties.

The use of such feed yarns, moreover, simplifies the manufacturing process. If high-shrinkage feed yarns are used, it is first of all necessary for example to produce many more loops than are to be found in the ready-produced sewing yarn, since the process of shrinkage reduces the number of loops. The two-component loop sewing yarn according to the invention need not be twisted during manufacture. It therefore is in the untwisted state and can also be used in the untwisted state as a sewing yarn. Usually, however, for example for better appearance, a relatively low twist of about 100 to 300 turns per meter is applied to it in the course of further processing.

EXAMPLE

An apparatus 10 for manufacturing the two-component loop sewing yarn according to the invention can be constructed as shown for example in the accompanying drawing from the following elements: a package creel (not shown) for the packages 11 and 13 of core feed yarn is and effect feed yarn 17, two parallel drawing systems 21 and 23 comprising heatable inlet and outlet godet rolls 25/27 and 26/28, respectively, a texturing jet 31 incorporating separate feed rollers (not shown) for the precise adjustment of the overfeed of the feed yarn strands 15 and 17, take-off rollers 33 and 35 for precisely adjusting the take-off of the textured yarn 37, optionally a customary hot air setting means, e.g. hot air oven 41, and a wind-up package 51.

The package creel is equipped with a package 11 of 380-dtex 40-filament (filament denier: 9.5 dtex) core feed yarn 15 and a package 13 of 83-dtex 24-filament (filament denier: 3.5 dtex) effect feed yarn 17. Both feed yarns 15 and 17 are composed of polyethylene terephthalate of IV 0.68 dl/g, measured in DCA at 25° C.

The two feed yarns 15 and 17 are fed to their separate drawing systems 21 and 23, where they are drawn in a ratio of 1:2 at an inlet godet roll temperature of 90° C. The drawing tension here was 15 cN/tex for the core feed yarn 15 and 14 cN/tex for the effect feed yarn 17. The drawn yarns were guided in 10 coils round the hot outlet godet rolls 26 and 28 of the drawing systems 21 and 23 at 230° C. The yarn speed for the two drawing systems 21 and 23 was separately adjusted in such a way that the inlet speed into the texturing jet 31 was 315 m/min for the core feed yarn 15 and 420 m/min for the effect feed yarn 17. The air textured yarn 37 was taken off downstream of the texturing jet 31 at 300 m/min. The result was an overfeed of 5% (or 1.05) for the core yarn 15 and 40% (or 1.40) for the effect yarn 17.

After emerging from the texturing jet 31, the loop yarn 37 was set at 240° C. by passing it through a hot air oven 41 160 cm in length.

The raw yarn 43 thus obtained was wound up. It has a count designation of 243 dtex/64 filament, an ultimate tenacity of 50.7 cN/tex, an ultimate tensile strength elongation of 9.8% and a heat shrinkage at 180° C. at 3.1%.

After dyeing, it had the following parameters: count designation 255 dtex/64 filament, ultimate tenacity 48 cN/tex, ultimate tensile strength elongation 13.2% and heat shrinkage at 180° C.: 0.7%.

In a sewing test, its average sewing length is more than 4,000 stitches in forward sewing and more than 2,000 stitches in backward sewing.

The same method can be used to manufacture the yarns according to the invention specified in the following table:

| Count designation of POY feed yarn | | Take-off speed downstream of texturing jet (m/min) | Intrinsic viscosity of PET | Draw ratio | | Overfeed | | Setting temperature |
|---|---|---|---|---|---|---|---|---|
| $LD_c$ | $LD_E$ | | | Core Yarn | Effect yarn | Core yarn | Effect yarn | |
| 380 σtex f 40 | 83 " f 24 | 300 | 0,68 | 2,1 | 2,1 | 1,05 | 1,40 | 256° |
| 380 " f 40 | 83 " f 24 | 300 | 0,68 | 2,1 | 2,1 | 1,05 | 1,40 | 250° |
| 380 " f 40 | 83 " f 24 | 300 | 0,68 | 2,1 | 2,1 | 1,05 | 1,40 | 240° |
| 380 " f 40 | 83 " f 24 | 600 | 0,68 | 2,1 | 2,1 | 1,05 | 1,40 | 283° |
| 380" f 40 | 83 " f 24 | 900 | 0.68 | 2,1 | 2,1 | 1.05 | 1,20 | 301° |
| 760" f 80 | 83 " f 24 | 300 | 0.68 | 2,1 | 2,1 | 1,05 | 1,40 | 258° |
| 950" f 100 | 166 " f 48 | 300 | 0.68 | 2,1 | 2,1 | 1,05 | 1,40 | 290° |
| 426" f 96 | 84 " f 24 | 300 | 0,80 | 2,103 | 2,103 | 1,05 | 1,40 | 255° |
| 486" f 64 | 84 " f 24 | 300 | 0,80 | 2,103 | 2,103 | 1,08 | 1,50 | 240° |

| Count designation of POY feed yarn | | Raw yarn data | | | | Data of dyed yarn | | | | Sewing test average sewing Length (stitches) | |
|---|---|---|---|---|---|---|---|---|---|---|---|
| $LD_c$ | $LD_E$ | Count designation | Ultimate tenacity | Ultimate tensile strength elongation | 180° C. shrinkage | Count | Ultimate tenacity | Ultimate tensile strength elongation | 180° C. shrinkage | | |
| 380 σtex f 40 | 83 " f 24 | 247164 | 52,9 | 13,1 | 2,9 | 267 | 47,7 | 15 | 0,5 | >4000 | >2000 |
| 380 " f 40 | 83 " f 24 | 244764 | 48,5 | 10,1 | 3,5 | 253 | 50,7 | 14,2 | 0,7 | " | " |
| 380 " f 40 | 83 " f 24 | 243764 | 51,3 | 11,5 | 3,6 | 252 | 50,8 | 13,8 | 0,6 | " | " |
| 380 " f 40 | 83 " f 24 | 244764 | 54,4 | 12,6 | 4,2 | 253 | 54,4 | 15,9 | 0,9 | " | " |
| 380" f 40 | 83 " f 24 | 238764 | 56,5 | 12,2 | 4,3 | 257 | 51,5 | 13,9 | 1,2 | " | " |
| 760" f 80 | 83 " f 24 | 4337104 | 56,5 | 12,0 | 4,2 | 455 | 52,6 | 13,8 | 0,5 | " | " |
| 950" f 100 | 166 " f 48 | 6517148 | 49,5 | 12,4 | 4,4 | 679 | 47,0 | 14,0 | 0,7 | " | " |
| 426" f 96 | 84 " f 24 | 2567120 | 56 | 9,7 | | 269 | 56,8 | 14,0 | 1,1 | " | " |
| 486" f 64 | 84 " f 24 | 304188 | 50 | 12,4 | | 320 | 52,5 | 16,7 | 1,0 | " | " |

We claim:

1. A process for manufacturing a loop sewing yarn having a plurality of components, said plurality of components comprising core and effect filaments of high tenacity and low shrinkage and made of synthetic polymers having an ultimate tenacity of above 40 cN/tex, a thermoshrinkage at 180° C. of below 8% and an ultimate tensile strength elongation of below 18%, said process comprising:

supplying to a texturing jet a core feed yarn strand and an effect feed yarn strand, the core feed yarn strand and the effect feed yarn strand being supplied at different speeds, the core feed yarn strand and the effect feed yarn strand having different total and filament linear densities but both of said feed yarn strands comprising high-tenacity, low shrinkage and low-stretch filaments, wherein the high-tenacity, low-shrinkage and low-stretch filaments of both of said feed yarn strands comprise a synthetic polymer having an ultimate tenacity of at least 65 cN/tex, a thermoshrinkage at 180° C. of not more than 9% and an ultimate tensile strength elongation of at least 8%, further wherein the core feed yarn strand filaments are fed into the texturing jet at an overfeed of 3 to 10% and the effect feed yarn filaments are fed into the texturing jet at an overfeed of 10 to 60% and air-jet texturing both of said feed yarn strands.

2. The process as claimed in claim 1, wherein the high-tenacity, low-shrinkage and low-stretch filaments of both of said feed yarn strands comprise a synthetic polymer having an ultimate tenacity of from 65 to 90 cN/tex, a thermoshrinkage at 180° C. of from 5 to 9% and an ultimate tensile strength elongation of from 8 to 15%.

3. The process of claim 2, wherein the high-tenacity, low-shrinkage and low-stretch filaments of both of said feed yarn strands comprise a synthetic polymer having an ultimate tenacity of from 70 to 80 cN/tex, a thermoshrinkage at 180° C. of from 6 to 8% and an ultimate tensile strength elongation of from 8.5 to 12%.

4. The process as claimed in claim 1, wherein the total linear densities of core and effect feed yarn strands are in the ratio of 95:5 to 70:30 and, taking into account the overfeed, after entanglement their blend has a linear density of 200 to 900 dtex.

5. The process as claimed in claim 1, wherein the linear density of the core feed yarn strand filaments fed into the texturing jet is 8 to 1.2 dtex and the linear density of the effect feed yarn strand filaments fed into the texturing jet is 4.5 to 1 dtex, the linear density of the core filament being 1.2 to 6 times the linear density of the effect feed yarn strand filament.

6. The process as claimed in claim 1, wherein the yarn emerging from the texturing jet is set at a temperature of 200° to 320° C.

7. A process for manufacturing a loop sewing yarn having a plurality of components, said plurality of components comprising core and effect filaments of high tenacity and low shrinkage and made of synthetic polymers, said loop sewing yarn having an ultimate tenacity of above 40 cN/tex, a thermoshrinkage at 180° C. of below 8% and an ultimate tensile strength elongation of below 18%, said process comprising:

drawing a partially oriented yarn material which comprises filaments of a synthetic polymer wherein said drawing is performed at a temperature of 70° to 100° C. under a drawing tension of 10 to 25 cN/tex, based on the linear density of the filaments after the drawing step, and immediately thereafter heat treating said yarn material in an essentially shrinkage-free manner to form a core feed yarn strand comprising high-tenacity, low shrinkage and low-stretch filaments having an ultimate tenacity of at least 65 cN/tex, a thermoshrinkage at 180° C. of not more than 9% and an ultimate tensile strength elongation of at least 8%, drawing a partially oriented yarn material which comprises filaments of a synthetic polymer wherein said drawing is performed at a temperature of 70° to 100° C. under a drawing tension of 10 to 25 cN/tex, based on the linear density of the filaments after the drawing step, and immediately thereafter heat treating said yarn material in an essentially shrinkage-free manner to form an effect feed yarn strand comprising high-tenacity, low shrinkage and low-stretch filaments having an ultimate tenacity of at least 65 cN/tex, a thermoshrinkage at 180° C. of not more than 9% and an ultimate tensile strength elongation of at least 8%, wherein said core feed yarn strand and said effect feed yarn strand have different total and filament linear densities, feeding said core feed yarn strand and said effect feed yarn strand to a texturing jet immediately after the drawing and heat treatment steps performed in the formation of the core and effect feed yarn strands, said core feed yarn strand and said effect feed yarn strand being fed to said texturing jet at different speeds, and air-jet texturing both of said feed yarn strands.

8. The process of claim 7, wherein said drawing is carried out by means of heated godet rolls.

9. A process for manufacturing a loop sewing yarn having a plurality of components, said plurality of components comprising core and effect filaments of high tenacity and low shrinkage and made of synthetic polymers, said loop sewing yarn having an ultimate tenacity of above 40 cN/tex, a thermoshrinkage at 180° C. of below 8% and an ultimate tensile strength elongation of below 18%, said process comprising:

drawing a partially oriented yarn material which comprises a synthetic polymer and immediately thereafter heat treating said yarn material in an essentially shrinkage-free manner at a yarn tension of 2 to 20 cN/tex and a temperature of 180° to 250° C. to form a core feed yarn strand comprising high-tenacity, low shrinkage and low-stretch filaments having an ultimate tenacity of at least 65 cN/tex, a thermoshrinkage at 180° C. of not more than 9% and an ultimate tensile strength elongation of at least 8%, drawing a partially oriented yarn material which comprises a synthetic polymer and immediately thereafter heat treating said yarn material in an essentially shrinkage-free manner at a yarn tension of 2 to 20 cN/tex and a temperature of 180° to 250° C. to form an effect feed yarn strand comprising high-tenacity, low shrinkage and low-stretch filaments having an ultimate tenacity of at least 65 cN/tex, a thermoshrinkage at 180° C. of not more than 9% and an ultimate tensile strength elongation of at least 8%, wherein said core feed yarn strand and said effect feed yarn strand have different total and filament linear densities, feeding said core feed yarn strand and said effect feed yarn strand to a texturing jet immediately after the drawing and heat treatment steps performed in the formation of the core and effect feed yarn strands, said core feed yarn strand and said effect feed yarn strand being fed to said texturing jet at different speeds, and air-jet texturing both of said feed yarn strands.

10. The process as claimed in claim 7, wherein the yarn emerging from the texturing jet is set at a temperature of 200° to 320° C.

11. The process as claimed in claim 9, wherein the yarn emerging from the texturing jet is set at a temperature of 200° to 320° C.

12. The process as claimed in claim 9, wherein the drawing of the core feed yarn strand filaments is carried out under essentially the same conditions as the drawing of the effect feed yarn strand filaments.

* * * * *